US011141786B2

(12) United States Patent
Yoo et al.

(10) Patent No.: US 11,141,786 B2
(45) Date of Patent: Oct. 12, 2021

(54) METHOD FOR MANUFACTURING METAL FOAM

(71) Applicant: LG Chem, Ltd., Seoul (KR)

(72) Inventors: Dong Woo Yoo, Daejeon (KR); Jin Kyu Lee, Daejeon (KR)

(73) Assignee: LG Chem, Ltd.

( * ) Notice: Subject to any disclaimer, the term of this patent is extended or adjusted under 35 U.S.C. 154(b) by 252 days.

(21) Appl. No.: 16/089,191

(22) PCT Filed: Apr. 3, 2017

(86) PCT No.: PCT/KR2017/003614
§ 371 (c)(1),
(2) Date: Sep. 27, 2018

(87) PCT Pub. No.: WO2017/171511
PCT Pub. Date: Oct. 5, 2017

(65) Prior Publication Data

US 2020/0009658 A1 Jan. 9, 2020

(30) Foreign Application Priority Data

Apr. 1, 2016 (KR) ..... 10-2016-0040362
Mar. 30, 2017 (KR) ..... 10-2017-0040972

(51) Int. Cl.
*B22F 3/11* (2006.01)
*B22F 3/105* (2006.01)

(52) U.S. Cl.
CPC ..... *B22F 3/1121* (2013.01); *B22F 3/105* (2013.01); *B22F 2003/1053* (2013.01)

(58) Field of Classification Search
CPC ..... B22F 3/1121
(Continued)

(56) References Cited

U.S. PATENT DOCUMENTS 3,266,893 A 8/1966 Duddy
3,647,721 A 3/1972 Salyer et al.
(Continued)

FOREIGN PATENT DOCUMENTS

CN 102140599 A * 8/2011
EP 2050527 A1 4/2009
(Continued)

OTHER PUBLICATIONS

Translation JP-2005290494-A (Year: 2005).*
(Continued)

*Primary Examiner* — Coris Fung
*Assistant Examiner* — Danielle Carda
(74) *Attorney, Agent, or Firm* — Lerner, David, Littenberg, Krumholz & Mentlik, LLP

(57) ABSTRACT

The present application provides a method for manufacturing a metal foam. The present application can provide a method for manufacturing a metal foam, which is capable of forming a metal foam comprising uniformly formed pores and having excellent mechanical properties as well as the desired porosity, and a metal foam having the above characteristics. In addition, the present application can provide a method capable of forming a metal foam in which the above-mentioned physical properties are ensured, while being in the form of a thin film or sheet, within a fast process time, and such a metal foam.

11 Claims, 1 Drawing Sheet

(58) Field of Classification Search
USPC ..... 419/2
See application file for complete search history.

(56) References Cited

U.S. PATENT DOCUMENTS

| | | | | |
|---|---|---|---|---|
| 3,799,808 | A | 3/1974 | Hancock | |
| 2007/0274854 | A1 | 11/2007 | Kelly et al. | |
| 2008/0282537 | A1* | 11/2008 | Lee | H05K 3/1283 29/851 |
| 2011/0070491 | A1* | 3/2011 | Campbell | H01M 4/136 429/218.1 |
| 2013/0001460 | A1 | 1/2013 | Tomiyama et al. | |

FOREIGN PATENT DOCUMENTS

| | | | | |
|---|---|---|---|---|
| JP | H02254106 | A | | 10/1990 |
| JP | H05163082 | A | | 6/1993 |
| JP | H06287608 | A | | 10/1994 |
| JP | 2005290493 | A | * | 10/2005 |
| JP | 2005290494 | A | * | 10/2005 |
| JP | 2005290494 | A | | 10/2005 |
| JP | 2009102701 | A | * | 5/2009 |
| JP | 2009102701 | A | | 5/2009 |
| JP | 4837703 | B2 | | 12/2011 |
| KR | 100445314 | B1 | | 8/2004 |
| KR | 20140038795 | A | | 3/2014 |

OTHER PUBLICATIONS

Translation JP-2009102701-A (Year: 2009).*
Translation CN-102140599-A (Year: 2011).*
JP-2005290493-A Translation (Year: 2005).*
Search report from International Application No. PCT/KR2017/003614, dated Jul. 3, 2017.
"Nickel Powder Type 123", Vale Canada Limited, Sep. 2012, 4 pages.
Extended European Search Report and Written Opinion for EP Application No. 17775935.4, dated Feb. 14, 2019.
Hermel, et al., "Review of Induction Sintering: Fundamentals and Applications", Powder Metallurgy, vol. 23, No. 3, Jan. 1980, pp. 130-135.
Xu and Guida, "Comparison of Sizing Small Particles Using Different Technologies", Powder Technology, vol. 123, No. 2-3, Jun. 2003, pp. 145-153.

* cited by examiner

[Figure 1]
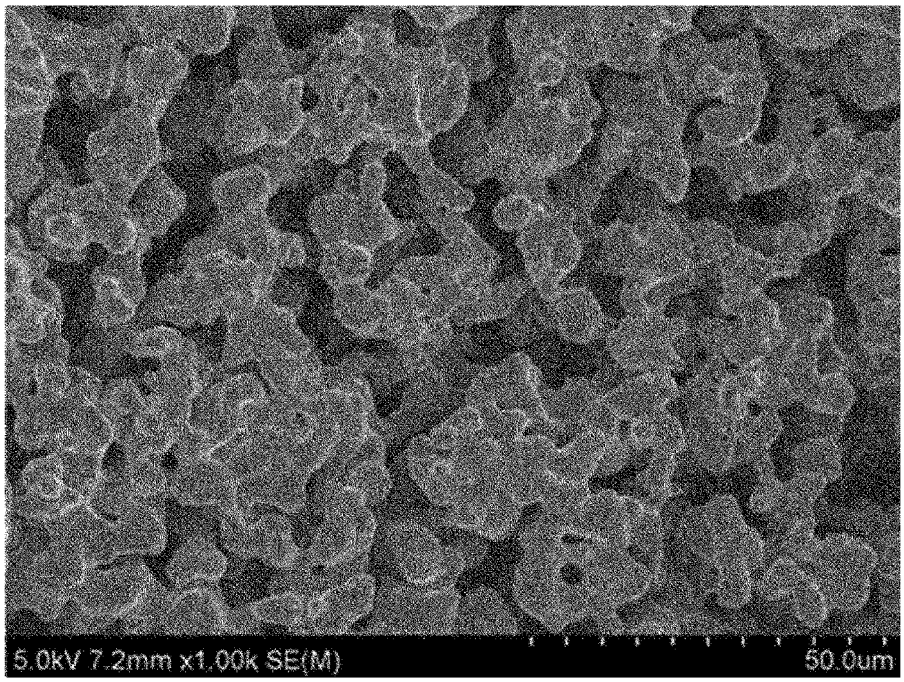
[Figure 2]
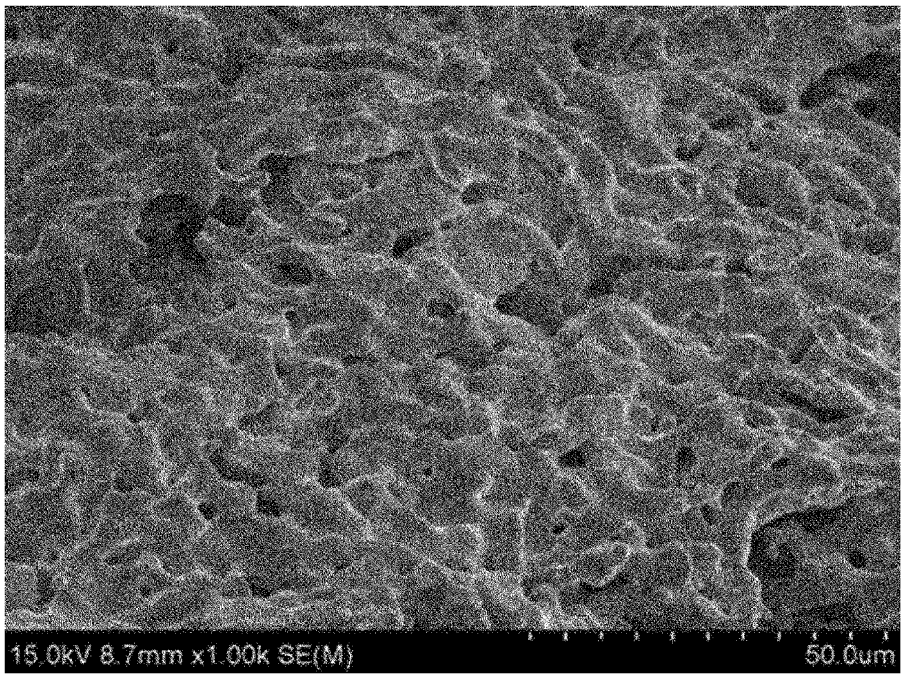

METHOD FOR MANUFACTURING METAL FOAM

CROSS-REFERENCE TO RELATED APPLICATIONS

The present application is a national phase entry under 35 U.S.C. § 371 of International Application No. PCT/KR2017/003614 filed on Apr. 3, 2017, which claims priority from Korean Patent Application No. 10-2016-0040362 filed on Apr. 1, 2016, and Korean Patent Application No. 10-2017-0040972 filed on Mar. 30, 2017, the disclosures of which are incorporated herein by reference in their entireties.

TECHNICAL FIELD

The present application relates to a method for manufacturing a metal foam.

BACKGROUND ART

Metal foams can be applied to various fields including lightweight structures, transportation machines, building materials or energy absorbing devices, and the like by having various and useful properties such as lightweight properties, energy absorbing properties, heat insulating properties, refractoriness or environment-friendliness. The metal foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is an object of the present invention to provide a method capable of manufacturing a metal foam comprising uniform pores and having excellent mechanical strength as well as a desired porosity.

Technical Solution

In this specification, the term metal foam or metal skeleton means a porous structure comprising a metal as a main component. Here, the metal as a main component means that the proportion of the metal is 55% by weight or more, 60% by weight or more, 65% by weight or more, 70% by weight or more, 75% by weight or more, 80% by weight or more, 85% by weight or more, 90% by weight or more, or 95% by weight or more based on the total weight of the metal foam or the metal skeleton. The upper limit of the proportion of the metal contained as the main component is not particularly limited and may be, for example, about 100% by weight, 99% by weight or 98% by weight or so.

The term porous property herein may mean a case where porosity is at least 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. The porosity can be calculated in a known manner by calculating the density of the metal foam or the like.

The method for manufacturing a metal foam of the present application may comprise a step of sintering a structure containing a metal component. In the present application, the term structure means a structure before the process performed to form the metal foam, such as the sintering process, that is, a structure before the metal foam is formed. In addition, even when the structure is referred to as a porous structure, the structure is not necessarily porous per se, and may be referred to as a porous structure for convenience, if it can finally form a metal foam, which is a porous metal structure.

In the present application, the structure may comprise a metal component and an organic binder, and a mixture comprising the metal component and the organic binder may be molded to form the structure.

In one example, the metal component may comprise at least a metal having a predetermined relative magnetic permeability and conductivity. According to one example of the present application, when an induction heating method as described below is applied as the sintering, the sintering according to the relevant method can be smoothly carried out by the application of such a metal.

For example, as the metal, a metal having a relative magnetic permeability of 90 or more may be used. The relative magnetic permeability ($\mu_r$) is the ratio ($\mu/\mu_0$) of the magnetic permeability ($\mu$) of the relevant material to the magnetic permeability ($\mu_0$) in the vacuum. The metal may have a relative magnetic permeability of 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The higher the relative magnetic permeability is, the higher the heat is generated at the time of application of the electromagnetic field for induction heating as described below, and thus the upper limit thereof is not particularly limited. In one example, the upper limit of the relative magnetic permeability may be, for example, about 300,000 or less.

The metal may be a conductive metal. The term conductive metal may mean a metal having a conductivity at 20° C. of about 8 MS/m or more, 9 MS/m or more, 10 MS/m or more, 11 MS/m or more, 12 MS/m or more, 13 MS/m or more, or 14.5 MS/m, or an alloy thereof. The upper limit of the conductivity is not particularly limited, and for example, the conductivity may be about 30 MS/m or less, 25 MS/m or less, or 20 MS/m or less.

In the present application, the metal having the relative magnetic permeability and conductivity as above may also be simply referred to as a conductive magnetic metal.

By applying the conductive magnetic metal, sintering can be more effectively performed when the induction heating process to be described below is carried out. Such a metal can be exemplified by nickel, iron or cobalt, but is not limited thereto.

If necessary, the metal component may comprise, together with the conductive magnetic metal, a second metal different from the metal. In this case, the metal foam may be formed of a metal alloy. As the second metal, a metal having the relative magnetic permeability and/or conductivity in the same range as the above-mentioned conductive magnetic metal may also be used, and a metal having the relative magnetic permeability and/or conductivity outside the range may be used. In addition, the second metal may also comprise one or two or more metals. The kind of the second metal is not particularly limited as long as it is different from the conductive magnetic metal to be applied, and for example, one or more metals, different from the conductive magnetic metal, of copper, phosphorus, molybdenum, zinc, manganese, chromium, indium, tin, silver, platinum, gold, aluminum or magnesium, and the like may be applied, without being limited thereto.

The proportion of the conductive magnetic metal in the metal component or the structure is not particularly limited. For example, the proportion can be adjusted so as to generate an appropriate Joule heat when applying the induction heating method as described below. For example, the metal component or structure may comprise the conductive magnetic metal in an amount of 30% by weight or more based on the weight of the entire metal component. In another example, the proportion of the conductive magnetic metal in the metal component or structure may be about 35% by weight or more, about 40% by weight or more, about 45% by weight or more, about 50% by weight or more, about 55% by weight or more, 60% by weight or more, 65% by weight or more, 70% by weight or more, 75% by weight or more, 80% by weight or more, 85% by weight or more, or 90% by weight or more. The upper limit of the conductive magnetic metal proportion is not particularly limited, and for example, the proportion of the conductive magnetic metal in the metal component or structure may be less than about 100% by weight, or 95% by weight or less. However, the above proportion is an exemplary ratio. For example, since the heat generated by induction heating due to application of an electromagnetic field can be adjusted according to the strength of the electromagnetic field applied, the electrical conductivity and resistance of the metal, and the like, the ratio can be changed depending on specific conditions.

The metal component forming the structure may be in the form of powder. For example, the metals in the metal component may have an average particle diameter in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the metal in the metal component, those having different average particle diameters may also be applied. The average particle diameter can be selected from an appropriate range in consideration of the shape of the desired metal foam, for example, the thickness or porosity of the metal foam, and the like.

The structure may comprise an organic binder together with the metal component. For example, the structure may be produced by molding a slurry comprising the metal component and the organic binder.

The kind of the organic binder that can be applied in the present application is not particularly limited. The organic binder can be exemplified by, for example, alkyl cellulose having an alkyl group having 1 to 8 carbon atoms such as methyl cellulose or ethyl cellulose, polyalkylene carbonate having an alkylene unit having 1 to 8 carbon atoms such as polypropylene carbonate or polyethylene carbonate, a polyvinyl alcohol-based binder such as polyvinyl alcohol or polyvinyl acetate; or polyalkylene oxide having an alkylene group having 1 to 8 carbon atoms such as polyethylene oxide or polypropylene oxide, and the like, but is not limited thereto.

In the structure, the organic binder may be contained in a ratio of, for example, about 10 parts by weight to 400 parts by weight, relative to 100 parts by weight of the metal component. The appropriate porosity can be secured by setting the above ratio to 10 parts by weight or more, and the foam shape can be stably maintained by setting the ratio to 400 parts by weight or less and efficiently performing calcination between the metal components. In another example, the ratio of the binder may be about 20 parts by weight or more, about 30 parts by weight or more, about 40 parts by weight or more, about 50 parts by weight or more, about 60 parts by weight or more, about 70 parts by weight or more, about 80 parts by weight or more, or about 90 parts by weight or more, or may be about 350 parts by weight or less, about 300 parts by weight or less, about 250 parts by weight or less, about 200 parts by weight or less, or about 150 parts by weight or less.

The structure may also comprise known additives, which are additionally required, in addition to the above-mentioned components. An example of such an additive can be exemplified by solvents or binders, and the like, but is not limited thereto.

The manner of forming the structure is not particularly limited. In the field of manufacturing metal foams, various methods for forming structures are known, and in the present application all of these methods can be applied. For example, the structure may be formed by holding a slurry comprising the metal component and the organic binder in a proper template, or by coating the mixture in an appropriate manner.

The shape of such a structure is not particularly limited as it is determined depending on the desired metal foam. In one example, the structure may be in the form of a film or a sheet. For example, when the structure is in the form of a film or a sheet, the thickness may be 5,000 μm or less, 3,500 μm or less, 2,000 μm or less, 1000 μm or less, 800 μm or less, 700 μm or less, or 500 μm or less. Metal foams have generally brittle characteristics due to their porous structural features, so that there are problems that they are difficult to be manufactured in the form of films or sheets, particularly thin films or sheets, and are easily broken even when they are made. However, according to the method of the present application, it is possible to form a metal foam having pores uniformly formed inside and excellent mechanical properties as well as a thin thickness.

Here, the lower limit of the structure thickness is not particularly limited. For example, the film or sheet shaped structure may have a thickness of about 10 μm or more, 50 μm or more, or about 100 μm or more.

The metal foam can be manufactured by sintering the structure formed in the above manner. In this case, a method of performing the sintering for producing the metal foam is not particularly limited, and a known sintering method can be applied. That is, the sintering can proceed by a method of applying an appropriate amount of heat to the structure in an appropriate manner.

As a method different from the existing known method, in the present application, the sintering can be performed by an induction heating method. That is, as described above, the metal component comprises the conductive magnetic metal having the predetermined magnetic permeability and conductivity, and thus the induction heating method can be applied. By such a method, it is possible to smoothly manufacture metal foams having excellent mechanical properties and whose porosity is controlled to the desired level as well as comprising uniformly formed pores.

Here, the induction heating is a phenomenon in which heat is generated from a specific metal when an electromagnetic field is applied. For example, if an electromagnetic field is applied to a metal having a proper conductivity and magnetic permeability, eddy currents are generated in the metal, and Joule heating occurs due to the resistance of the metal. In the present application, a sintering process through such a phenomenon can be performed. In the present application, the sintering of the metal foam can be performed in a short time by applying such a method, thereby ensuring the processability, and at the same time, the metal foam having excellent mechanical strength as well as being in the form of a thin film having a high porosity can be produced.

The sintering process may comprise a step of applying an electromagnetic field to the structure. By the application of the electromagnetic field, Joule heat is generated by the induction heating phenomenon in the conductive magnetic metal of the metal component, whereby the structure can be sintered. At this time, the conditions for applying the electromagnetic field are not particularly limited as they are determined depending on the kind and ratio of the conductive magnetic metal in the structure, and the like.

For example, the induction heating can be performed using an induction heater formed in the form of a coil or the like.

The induction heating can be performed, for example, by applying a current of 100 A to 1,000 A or so. In another example, the applied current may have a magnitude of 900 A or less, 800 A or less, 700 A or less, 600 A or less, 500 A or less, or 400 A or less. In another example, the current may have a magnitude of about 150 A or more, about 200 A or more, or about 250 A or more.

The induction heating can be performed, for example, at a frequency of about 100 kHz to 1,000 kHz. In another example, the frequency may be 900 kHz or less, 800 kHz or less, 700 kHz or less, 600 kHz or less, 500 kHz or less, or 450 kHz or less. In another example, the frequency may be about 150 kHz or more, about 200 kHz or more, or about 250 kHz or more.

The application of the electromagnetic field for the induction heating can be performed within a range of, for example, about 1 minute to 10 hours. In another example, the application time may be about 9 hours or less, about 8 hours or less, about 7 hours or less, about 6 hours or less, about 5 hours or less, about 4 hours or less, about 3 hours or less, about 2 hours or less, about 1 hour or less, or about 30 minutes or less.

The above-mentioned induction heating conditions, for example, the applied current, the frequency and the application time, and the like may be changed in consideration of the kind and the ratio of the conductive magnetic metal, as described above.

The sintering of the structure may be carried out only by the above-mentioned induction heating, or may also be carried out by applying an appropriate heat, together with the induction heating, that is, the application of the electromagnetic field, if necessary.

The metal foam may be formed by sintering the metal component, while removing the organic binder in the structure by the heat generated in the sintering process as above.

The present application is also directed to a metal foam. The metal foam may be one manufactured by the above-mentioned method. Such a metal foam may comprise, for example, at least the above-described conductive magnetic metal. The metal foam may comprise, on the basis of weight, 30% by weight or more, 35% by weight or more, 40% by weight or more, 45% by weight or more, or 50% by weight or more of the conductive magnetic metal. In another example, the proportion of the conductive magnetic metal in the metal foam may be about 55% by weight or more, 60% by weight or more, 65% by weight or more, 70% by weight or more, 75% by weight or more, 80% by weight or more, 85% by weight or more, or 90% by weight or more. The upper limit of the proportion of the conductive magnetic metal is not particularly limited, and may be, for example, less than about 100% by weight or 95% by weight or less.

The metal foam may have a porosity in a range of about 40% to 99%. As mentioned above, according to the method of the present application, porosity and mechanical strength can be controlled, while comprising uniformly formed pores. The porosity may be 50% or more, 60% or more, 70% or more, 75% or more, or 80% or more, or may be 95% or less, or 90% or less.

The metal foam may also be present in the form of thin films or sheets. In one example, the metal foam may be in the form of films or sheets. The metal foam of such a film or sheet form may have a thickness of 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. The film or sheet shaped metal foam may have a thickness of about 10 μm or more, about 20 μm or more, about 30 μm or more, about 40 μm or more, about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more, but is not limited thereto.

The metal foam can be utilized in various applications where a porous metal structure is required. In particular, according to the method of the present application, it is possible to manufacture a thin film or sheet shaped metal foam having excellent mechanical strength as well as the desired level of porosity, as described above, thus expanding applications of the metal foam as compared to the conventional metal foam.

Advantageous Effects

The present application can provide a method for manufacturing a metal foam, which is capable of forming a metal foam comprising uniformly formed pores and having excellent mechanical properties as well as the desired porosity, and a metal foam having the above characteristics. In addition, the present application can provide a method capable of forming a metal foam in which the above-mentioned physical properties are ensured, while being in the form of a thin film or sheet, and such a metal foam.

BRIEF DESCRIPTION OF DRAWINGS

FIGS. 1 and 2 are SEM photographs of metal foams formed in Examples 1 and 2, respectively.

MODE FOR INVENTION

Hereinafter, the present application will be described in detail by way of examples and comparative examples, but the scope of the present application is not limited to the following examples.

Example 1

Nickel powder (having a conductivity of about 14.5 MS/m, a relative magnetic permeability of about 600 or so, and an average particle diameter of about 10 to 20 μm or so) and ethyl cellulose were added in a weight ratio of about 1:1 to methylene chloride and mixed using a planetary mixer to prepare a slurry. The prepared mixture was coated on a quartz plate to a thickness of about 200 μm or so to produce a structure, and the structure was sintered by applying an electromagnetic field thereto with a coil-type induction heater to manufacture a metal foam. At this time, the electromagnetic field was formed by applying a current of about 350 A at a frequency of about 380 kHz, and the application time was about 3 minutes or so. The manufactured metal foam had a porosity of about 65%, and a SEM photograph thereof was shown in FIG. 1.

Example 2

A metal foam was manufactured in the same manner as in Example 1, except that polyethylene carbonate was used instead of ethyl cellulose. The manufactured metal foam had a porosity of about 45%, and a SEM photograph thereof was shown in FIG. 2.

Example 3

A metal foam was manufactured in the same manner as in Example 1, except that polyvinyl alcohol was applied instead of ethyl cellulose and water was applied instead of methylene chloride. The manufactured metal foam had a porosity of about 52%.

Example 4

A metal foam was prepared in the same manner as in Example 1, except that polyethylene oxide was used instead of ethyl cellulose. The manufactured metal foam had a porosity of about 57%.

The invention claimed is:

1. A method for manufacturing a metal foam comprising:

preparing a structure using a slurry, applying an electromagnetic field to the structure, wherein the slurry consists of a metal component, an organic binder, and optionally solvent and/or binder, wherein the metal component comprises a conductive metal having a relative magnetic permeability of 90 or more, wherein the metal component comprises, on the basis of weight, 30% by weight or more of the conductive metal, and wherein the metal component to which the electromagnetic field is applied is in the form of powder.

2. The method for manufacturing a metal foam according to claim 1, wherein the conductive metal has a conductivity at 20° C. of 8 MS/m or more.

3. The method for manufacturing a metal foam according to claim 1, wherein the conductive metal is nickel, iron or cobalt.

4. The method for manufacturing a metal foam according to claim 1, wherein the conductive metal has an average particle diameter in a range of 5 μm to 100 μm.

5. The method for manufacturing a metal foam according to claim 1, wherein the organic binder is alkyl cellulose, polyalkylene carbonate, polyvinyl alcohol, polyalkylene oxide or polyvinyl acetate.

6. The method for manufacturing a metal foam according to claim 1, wherein the slurry comprises 10 to 400 parts by weight of the organic binder, relative to 100 parts by weight of the metal component.

7. The method for manufacturing a metal foam according to claim 1, wherein the structure is in a film or sheet shape.

8. The method for manufacturing a metal foam according to claim 7, wherein the film or sheet shape has a thickness of 5,000 μm or less.

9. The method for manufacturing a metal foam according to claim 1, wherein the electromagnetic field is formed by applying a current in a range of 100 A to 1,000 A.

10. The method for manufacturing a metal foam according to claim 1, wherein the electromagnetic field is formed by applying a current at a frequency in a range of 100 kHz to 1,000 kHz.

11. The method for manufacturing a metal foam according to claim 1, wherein the electromagnetic field is applied for a time in a range of 1 minute to 10 hours.

* * * * *